US010344347B2

(12) United States Patent
Haarer

(10) Patent No.: US 10,344,347 B2
(45) Date of Patent: Jul. 9, 2019

(54) METHOD OF HARDENING A CLOTHING WIRE FOR PROCESSING TEXTILE FIBRES, AND APPARATUS SYSTEM THEREFOR

(71) Applicant: TRUETZSCHLER GMBH & CO. KG, Moenchengladbach (DE)

(72) Inventor: Friedrich Haarer, Neubulach (DE)

(73) Assignee: TRUETZSCHLER GMBH & CO. KG, Moenchengladbach (DE)

( * ) Notice: Subject to any disclaimer, the term of this patent is extended or adjusted under 35 U.S.C. 154(b) by 282 days.

(21) Appl. No.: 15/318,652

(22) PCT Filed: May 8, 2015

(86) PCT No.: PCT/EP2015/000951

§ 371 (c)(1),
(2) Date: Dec. 13, 2016

(87) PCT Pub. No.: WO2015/197150

PCT Pub. Date: Dec. 30, 2015

(65) Prior Publication Data

US 2017/0121784 A1 May 4, 2017

(30) Foreign Application Priority Data

Jun. 24, 2014 (DE) ..... 10 2014 108 822

(51) Int. Cl.
*C21D 9/26* (2006.01)
*C21D 1/18* (2006.01)
(Continued)

(52) U.S. Cl.
CPC ..... *C21D 9/26* (2013.01); *C21D 1/18* (2013.01); *C21D 1/52* (2013.01); *C21D 1/63* (2013.01);
(Continued)

(58) Field of Classification Search
None
See application file for complete search history.

(56) References Cited

U.S. PATENT DOCUMENTS 503,398 A 8/1893 Bateman
4,620,884 A * 11/1986 Heath ..... C21D 9/56 148/239
(Continued)

FOREIGN PATENT DOCUMENTS

CN 101519716 A 9/2009
CN 103436662 A 12/2013
(Continued)

OTHER PUBLICATIONS

International Search Report for PCT/EP2015/000951, dated Aug. 24, 2015, and English Translation thereof.
Written Opinion for PCT/EP2015/000951, dated Aug. 24, 2015.

*Primary Examiner* — Colleen P Dunn
*Assistant Examiner* — Jeremy C Jones
(74) *Attorney, Agent, or Firm* — Fisherbroyles, LLP; Robert Kinberg

(57) ABSTRACT

A method of hardening a clothing wire for processing textile fibers and to an apparatus system therefor. The clothing wire has a succession of teeth arranged in its longitudinal direction, and the clothing wire is guided through a heating region in a pass-through direction for contact with at least one open flame. The heating region is followed by a quenching bath having a quenching liquid and by a subsequent tempering apparatus. The clothing wire moving in the pass-through direction is flushed around with a protective medium in a transition region between the region of contact with the open flame and the entry into the quenching liquid.

9 Claims, 3 Drawing Sheets

(51) Int. Cl.

| | |
|---|---|
| ***C21D 1/52*** | (2006.01) |
| ***C21D 1/63*** | (2006.01) |
| ***C21D 6/00*** | (2006.01) |
| ***C21D 9/52*** | (2006.01) |
| ***C21D 9/573*** | (2006.01) |
| ***D01G 15/88*** | (2006.01) |
| *C21D 9/56* | (2006.01) |

(52) U.S. Cl.
CPC ..... *C21D 6/00* (2013.01); *C21D 9/525* (2013.01); *C21D 9/5732* (2013.01); *D01G 15/88* (2013.01); *C21D 9/56* (2013.01)

(56) References Cited

U.S. PATENT DOCUMENTS

| | | | | |
|---|---|---|---|---|
| 5,123,529 | A * | 6/1992 | Hollingsworth ..... | D01G 15/88 266/103 |
| 5,145,534 | A | 9/1992 | Weedaeghe et al. | |
| 7,743,470 | B2 | 6/2010 | Graf | |
| 2007/0028423 | A1* | 2/2007 | Graf ..... | C21D 9/24 19/300 |

FOREIGN PATENT DOCUMENTS

| | | | |
|---|---|---|---|
| DE | 102005025627 | B3 | 10/2006 |
| EP | 1078994 | A2 | 2/2001 |
| EP | 1728878 | A2 | 12/2006 |

* cited by examiner

METHOD OF HARDENING A CLOTHING WIRE FOR PROCESSING TEXTILE FIBRES, AND APPARATUS SYSTEM THEREFOR

CROSS-REFERENCE TO RELATED APPLICATIONS

This application is a U.S. National Stage of International Patent Application No. PCT/EP2015/000951 filed May 8, 2015, designating the United States and claiming benefit of German Patent Application No. 10 2014 108 822.0 filed Jun. 24, 2014.

BACKGROUND OF THE INVENTION

The present invention relates to a method of hardening a clothing wire for processing textile fibres and to an apparatus system therefor, the clothing wire having a succession of teeth arranged in its longitudinal direction, and the clothing wire being guided through a heating region in a pass-through direction for contact with at least one open flame, the heating region being followed by a quenching bath having a quenching liquid and by a subsequent tempering apparatus.

Clothing wires have a sawtooth profile and are drawn onto cylindrical drums or rolls to form a carding machine. As a result, the carding machines have an envelope surface which is provided with teeth; a clothing wire can be used, for example, to form a cylinder or doffer and can have a length of several kilometers. In order to provide the clothing wire with sufficient strength and wear-resistance, methods of hardening the clothing wire, which are based especially on flame hardening, are known.

In the process, the hardening method preferably makes use of an open flame to form a heating region, through which the clothing wire is guided in its longitudinal direction. In the process, only the teeth are to be hardened and the tooth foot should have a high degree of toughness, which can be achieved, for example, by means of soft annealing.

Upstream of the heating region there can be provided a rinsing chamber, which allows at least partial cleaning of the clothing wire. After passing through the heating region, the clothing wire has to be quenched, for which purpose the clothing wire is led into a quenching bath filled with a quenching liquid. Following on therefrom, the clothing can be led through a tempering apparatus and through a cooling apparatus which follows on from the tempering apparatus.

Hardening a clothing wire over an open flame has been found to be especially advantageous, although scale can form on the surface of the clothing wire, which is always to be avoided. Especially when drawing the clothing wire onto a drum or roll, problems can arise when the clothing wire surface has scaling, because the clothing wire has to be drawn onto the cylindrical roll helically with a high degree of dimensional accuracy, and for drawing-on there is used a wire-guiding device, which cannot function properly in the case of a clothing wire surface that has scaling.

From DE 10 2005 025 627 B3 there is known a method of hardening a clothing wire, in which it is proposed that the hardening process itself be carried out with exclusion of oxygen. For that purpose protective gas has to be introduced into the heating region, with only so much oxygen being added for formation of the open flame as is necessary for reaction with a fuel gas. In order to feed in a protective gas whilst simultaneously introducing a fuel/air mixture, there is proposed a mixing device so that the fuel/air mixture is burnt in such a way that no non-combusted oxygen reaches the clothing wire. Accordingly the atmosphere in the heating region has to be kept free of oxygen, for which purpose therefore the protective gas is additionally introduced into the heating region.

However, further tests have shown, surprisingly, that scaling on the clothing wire at the exit from the heating region can be avoided even without introducing protective gas into the heating region. The reason therefor may be residues of cleaning agents, oils or other hydrocarbons which adhere to the surface of the clothing wire and which burn in the open flame and so prevent a reaction of the clothing wire with oxygen. The finding is based especially on the fact that at the immediate exit of the clothing wire from the heating region there is no scaling on the surface of the clothing wire. However, after following through the complete method for hardening the clothing wire, scaling is nevertheless to be found on the surface of the clothing wire. From this scale formation it can be concluded that the clothing wire, whilst still in a hot state, comes into contact with a reactant, which is to be avoided.

SUMMARY OF THE INVENTION

The problem of the invention is to further develop a method of hardening a clothing wire for processing textile fibres which, in spite of a simple construction of the apparatus system for hardening the clothing wire, makes possible a scale-free clothing wire surface. The onerous purging of the heating region with a protective gas is to be avoided especially.

The invention includes the technical teaching that the clothing wire moving in the pass-through direction is flushed around with a protective medium in a transition region between the region of contact with the open flame and the entry into the quenching liquid.

In this the invention is based on the idea that the clothing wire is flushed around with a protective medium between the open flame and immersion into the quenching liquid so that contact of the clothing wire with oxygen is still avoided even after the clothing wire has passed through the heating region. Investigations have shown that, even after the clothing wire has emerged from the heating region, the temperature of the clothing wire is still sufficiently high for a reaction of the material of the clothing wire with oxygen also to result in scaling on the surface of the clothing wire subsequently. The scaling on the clothing wire in that case does not come about in the heating region itself but rather only after exiting the heating region; this is effectively avoided in accordance with the invention by flushing around the clothing wire with a protective medium. When the clothing wire comes into contact with the quenching liquid in the quenching bath, the temperature of the clothing wire is lowered to the extent that contact of the clothing wire with oxygen after passing through the quenching bath does not result in further scaling. In consequence, the method of hardening a clothing wire in accordance with the invention makes it possible to make available a scale-free clothing wire by simple means. In the process, in contrast to the prior art, it is possible to dispense with a costly heating chamber or oven within which the flames are produced and which in accordance with the invention does not need to be kept free of oxygen.

For example, in the transition region between the heating region and the quenching bath, the clothing wire can be flushed around with nitrogen, which forms the protective medium, although alternative protective media can also be used, especially inert gases. In formation of the transition region it is important that the clothing wire be transferred from the open flame to the transition region directly so that the clothing wire is immediately flushed around with nitrogen. Equally important is the direct transfer of the clothing wire from the nitrogen atmosphere into the quenching liquid. The transition region is therefore so constructed that the clothing wire is transferred from the open flame directly into the protective medium; and from the transition region the clothing wire must be transferred directly from the protective medium into the quenching liquid.

The transition region can, for example, be surrounded by a protection chamber into which the protective medium is introduced. The transition region must have a minimum dimension in the pass-through direction in order to provide a sufficient spacing between the quenching bath and the heating region, so that the quenching liquid in the quenching bath is not heated by the open flame of the heating region. The protection chamber can be of box-like or also, for example, tubular construction, and a protective medium can be introduced via a regulating valve. The protective medium can especially be so introduced into the protection chamber that the protective medium flows through the protection chamber contrary to the pass-through direction.

The protection chamber can be at more than atmospheric pressure owing to the introduction of the protective medium, it then being possible for the protection chamber to have an entry aperture through which the clothing wire runs into the protection chamber; at the same time the protective medium can flow out from the protection chamber through the entry aperture contrary to the pass-through direction, for example into the heating region. The protective medium can then be carried off through the open flames and drawn off under suction via an extractor hood.

In accordance with an advantageous variant of the method according to the invention, the protective medium can consist not of a gas, or not exclusively of a gas, but rather of a liquid, for example the quenching liquid from the quenching bath. For that purpose, in order to bridge the transition region, provision can be made for the quenching liquid to be brought towards the heating region, and preferably substantially as far as the heating region, contrary to, that is against or opposite to, the pass-through direction. According to the advantageous variant, the quenching liquid can bridge the transition region without the quenching bath itself extending as far as the heating region.

For example, the quenching liquid can be brought, with a flow movement in a flow direction, from the quenching bath as far as the heating region, the flow direction being contrary to the pass-through direction of the clothing wire. For example, the bridging region can be formed by a wire conduit tube or a wire conduit channel, through which the quenching liquid runs contrary to the pass-through direction. The entry aperture for entry of the clothing wire into the wire conduit tube or wire conduit channel can extend as far as the heating region, and the quenching liquid that emerges can be collected by means of a collecting apparatus and returned to the quenching bath. The result of the flow in the quenching liquid is that, by virtue of its being continuously replaced, the quenching liquid is substantially not heated up by the hot clothing wire which enters it or by the flames.

The clothing wire can be so guided through the heating region that the tooth structure of the clothing wire faces towards the open flame. In that case the open flame in the heating region can be brought to the clothing wire from above or from below. When the transition region has, for example, a wire conduit tube, through which the quenching liquid is guided as far as a tube entry aperture, the open flame can burn upwards and the clothing wire is located above the open flame, at a spacing. When the transition region has a wire conduit channel, the open flame can also, as an alternative, be directed downwards and be brought as far as the channel or can even slightly overlap with the latter, so that the clothing wire from the open flame directly enters the wire conduit channel filled with quenching liquid. Especially as a result thereof, an overlap can be produced between the open flame and the wire conduit channel, preferably being constructed so as to be minimal, although it is possible even without using protective gas for the clothing wire to be safely transferred from the open flame into the quenching liquid with exclusion of oxygen.

Alternatively, the clothing wire can also be arranged in the uncoiled direction, which is to say a lateral face of the clothing wire faces the open flame and the opposite lateral face faces away therefrom. Ultimately the orientation of the teeth relative to the open flame is not of fundamental importance to the invention, but it can be utilised in order to additionally influence the desired properties of the teeth and/or tooth feet by means of the heat treatment. Preferably, the open flame is directed towards only the teeth and/or tooth structure.

The present invention is further directed to an apparatus system for hardening a clothing wire for processing textile fibres, having a succession of teeth arranged in its longitudinal direction, wherein a heating region is provided with an open flame, through which heating region the clothing wire is arranged to be guided in a pass-through direction, and wherein the heating region is followed by a quenching bath having a quenching liquid and by a subsequent tempering apparatus. In accordance with the invention a transition region is arranged between the region of contact with the open flame and the entry into the quenching liquid, which transition region is constructed for flushing around the clothing wire with a protective medium.

The transition region can be formed by a protection chamber, which is filled at least partly with a protective medium and which especially is flushed therewith. For example, the protection chamber can be constructed in box form or tubular form.

The protective medium can be formed by nitrogen, although further inert gases can also be used.

Alternatively, the protective medium can be formed by the quenching liquid from the quenching bath. In that case, the transition region can have a wire conduit tube or a wire conduit channel, through which quenching liquid is arranged to be conveyed in the direction of the heating region. The wire conduit tube can be of enclosed construction and terminate in a tube entry aperture into which the clothing wire runs and out from which the quenching liquid runs, for example into a collecting apparatus. The wire conduit channel can be constructed, for example, so that it is open to the top, and the upper flame of the heating region can extend over the wire conduit channel up to the end, especially with a slight overlap, so that the clothing wire can enter the quenching liquid directly from the open flame.

The open flame can be brought to the clothing wire in the heating region from above or from below, depending on whether a wire conduit tube or, for example, a wire conduit channel is used. Especially when a wire conduit channel is used to form the bridging region, the flame can be arranged above the clothing wire and burn downwards onto the clothing wire.

BRIEF DESCRIPTION OF THE DRAWINGS

Further measures which improve the invention are described in greater detail with reference to preferred examples of embodiments hereinbelow together with the description of a preferred example of an embodiment of the invention, referring to the Figures, wherein.

DETAILED DESCRIPTION OF THE INVENTION

Figure 1:
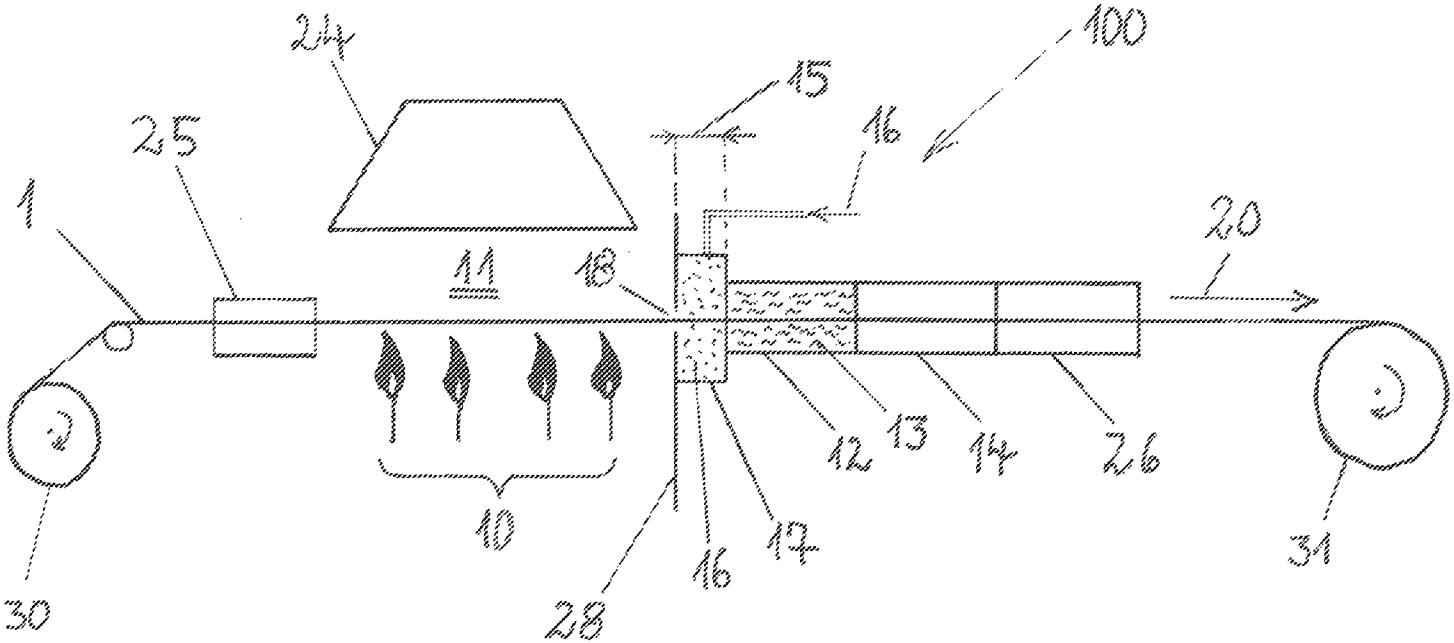
FIG. 1 shows, in a diagrammatic view, a first example of an embodiment of an apparatus system for hardening a clothing wire and for carrying out the method according to the invention.

FIG. 1 shows, in a diagrammatic view, a first example of an embodiment of an apparatus system 100 for carrying out the method of hardening a clothing wire 1 having the features of the present invention. The clothing wire 1 is made available on a reel 30 and is unwound therefrom in order to be introduced into the apparatus system 100. When the hardened clothing wire 1 re-emerges from the apparatus system 100, it is re-wound onto a further reel 31. Usually, a lateral face of the clothing wire 1 therein faces downwards, and the opposite lateral face of the clothing wire 1 faces upwards. However, it can also be expedient for the teeth to be arranged upside-down facing the burner orifice, which means that the clothing wire 1 has to be rotated through 90° along the wire running direction 20 after and before the reels 30, 31. The residual heat from the teeth can then pass into the tooth foot, which can be exploited in the process for the purpose of increasing the toughness of the tooth feet.

When the clothing wire 1 runs off the reel 30, it is first directed into a washing chamber 25 serving to clean the clothing wire 1. The clothing wire then runs out of the washing chamber 25 and enters a heating region 11 basically formed by one or more flames 10. The clothing wire 1 therein runs above the flames 10 through the heating region 11, for example with a spacing of about 6 mm from a lateral surface to the burner orifice. Above the clothing wire 1 there is located an extractor hood 24 in order to draw off, under suction, gases produced in the heating region 11. The flames 10 are produced by a plurality of burners, which are fixed on a mounting (not shown) and fed with a fuel gas such as, for example, natural gas or propane gas. The burners therein are not encapsulated within the apparatus system 100 or arranged in a burner chamber or oven, but rather they are freely accessible and are fed by way of the ambient air and possibly with additional oxygen.

In accordance with the invention, following on from the heating region 11 there is a transition region 15, the front of which can be formed by a partition wall 28, an entry aperture 18 having in that case been introduced into the partition wall 28, followed on the rear side of the partition wall 28 by a protection chamber 17. The illustration shows the open flames 10 in merely diagrammatic form, it being possible for the open flames 10 and consequently the heating region 11 to be provided adjacent to the partition wall 28.

The protection chamber 17 is filled with a protective medium 16, for example nitrogen. The protection chamber 17 can be constantly replenished, by way of a feed line, with the protective medium 16, which passes out again from the entry aperture 18. Following on from the transition region 15 in the pass-through direction 20 there is a quenching bath 12, which is filled with a quenching liquid 13, and following on from the quenching bath 12 is a tempering apparatus 14. Finally, the clothing wire 1, after passing through the tempering apparatus 14, also runs into a cooling apparatus 26, from which the hardened clothing wire 1 re-emerges cooled, so that the clothing wire 1 can be re-wound onto a further reel 31.

In accordance with the invention, between the heating region 11 and the quenching bath 12 there is located a transition region 15, which is provided in order to create a spacing between the heating region 11 and the quenching bath 12. The purpose thereof is especially to avoid the quenching liquid 13 of the quenching bath 12 being heated at the open flame 10. The transition region 15 is formed by the protection chamber 17, which is flushed with the protective medium 16 so that the clothing wire 1 after emerging from the open flame 10 does not come into contact with oxygen before entering the quenching bath 12. As a result, scale formation is avoided; in addition, as a result of the protective medium 16 flowing out from the entry aperture 18, oxygen is prevented from reaching the clothing wire 1.

Over the route section of the open flame 10, as a result of the contact with the open flame 10, the clothing wire 1 also cannot come into contact with oxygen because oxygen residues burn together with substances adhering to the surface of the clothing wire 1, as a result of which scaling on the clothing wire 1 is avoided. As a result of the construction, in accordance with the invention, of a transition region 15 having a protective gas atmosphere, there is consequently made available by simple means an apparatus system 100 which makes possible scale-free hardening of a clothing wire 1 of an all-steel clothing for processing textile fibres. It is therefore no longer necessary to flush a heating or hardening chamber with nitrogen at above atmospheric pressure, which makes the method considerably cheaper in terms of operating costs and makes retro-fitting easier.

Figure 2:
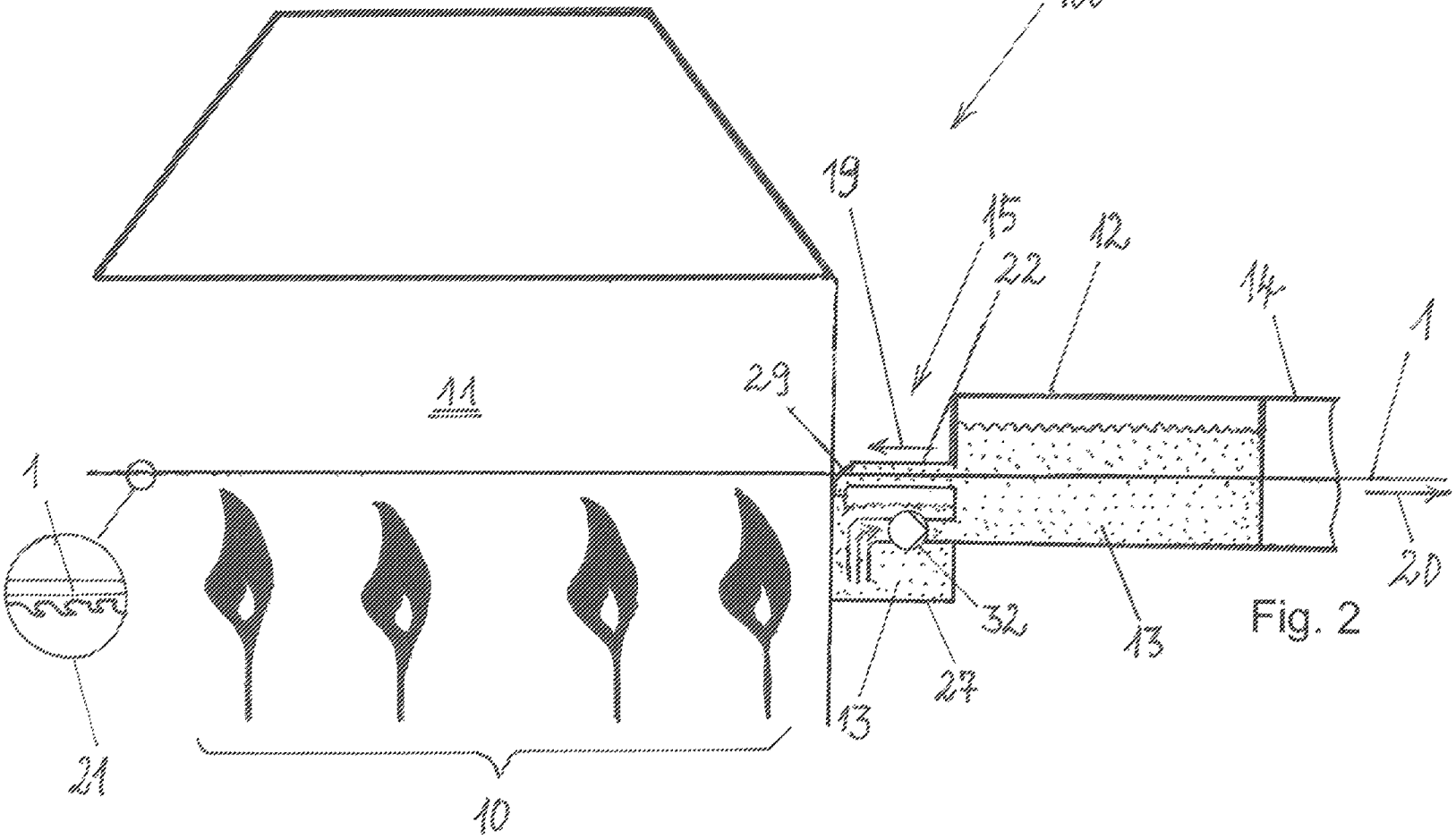
FIG. 2 shows a view, to an enlarged scale, of the heating region and, following on therefrom, the transition region with a modified variant of the transition region.

FIG. 2 shows a modified example of an embodiment of the apparatus system 100 in the heating region 11 together with the quenching bath 12, which follows on therefrom. The open flames 10 are located beneath the clothing wire 1, which has a tooth structure 21 which can also be directed downwards, that is to say towards the open flame 10, as shown in the inset view to an enlarged scale. Alternatively, the clothing wire 1 can also be arranged in the uncoiled direction, that is to say a lateral face of the clothing wire faces the flame 10 and the opposite lateral face faces away therefrom.

Following on from the heating region 11 is the transition region 15, which creates a spacing formed in the pass-through direction 20 between the heating region 11 and the quenching bath 12. In order to avoid contact of the clothing wire 1 with oxygen, there extends out from the quenching bath 12 a wire conduit tube 22, through which quenching liquid 13 runs in a flow direction 19. The flow direction 19 is arranged contrary to the pass-through direction 20, and the clothing wire 1 enters the wire conduit tube 2 by way of a tube entry aperture 29, while quenching liquid 13 flows out from the tube entry aperture 29 and into a collecting apparatus 27. The quenching liquid 13 can be pumped back into the quenching bath 12 by way of a pump 32.

The wire conduit tube 22 is brought so far up to the heating region 11 that the emerging quenching liquid 13 makes possible the direct transfer of the clothing wire 1 from the region of the open flames 10 into the quenching liquid 13. As a result, all contact with oxygen is avoided, and the clothing wire 1 can emerge from the heating region 11 without scaling and can be quenched in the quenching bath 12 in order to subsequently enter the tempering apparatus 14.

Figure 3:
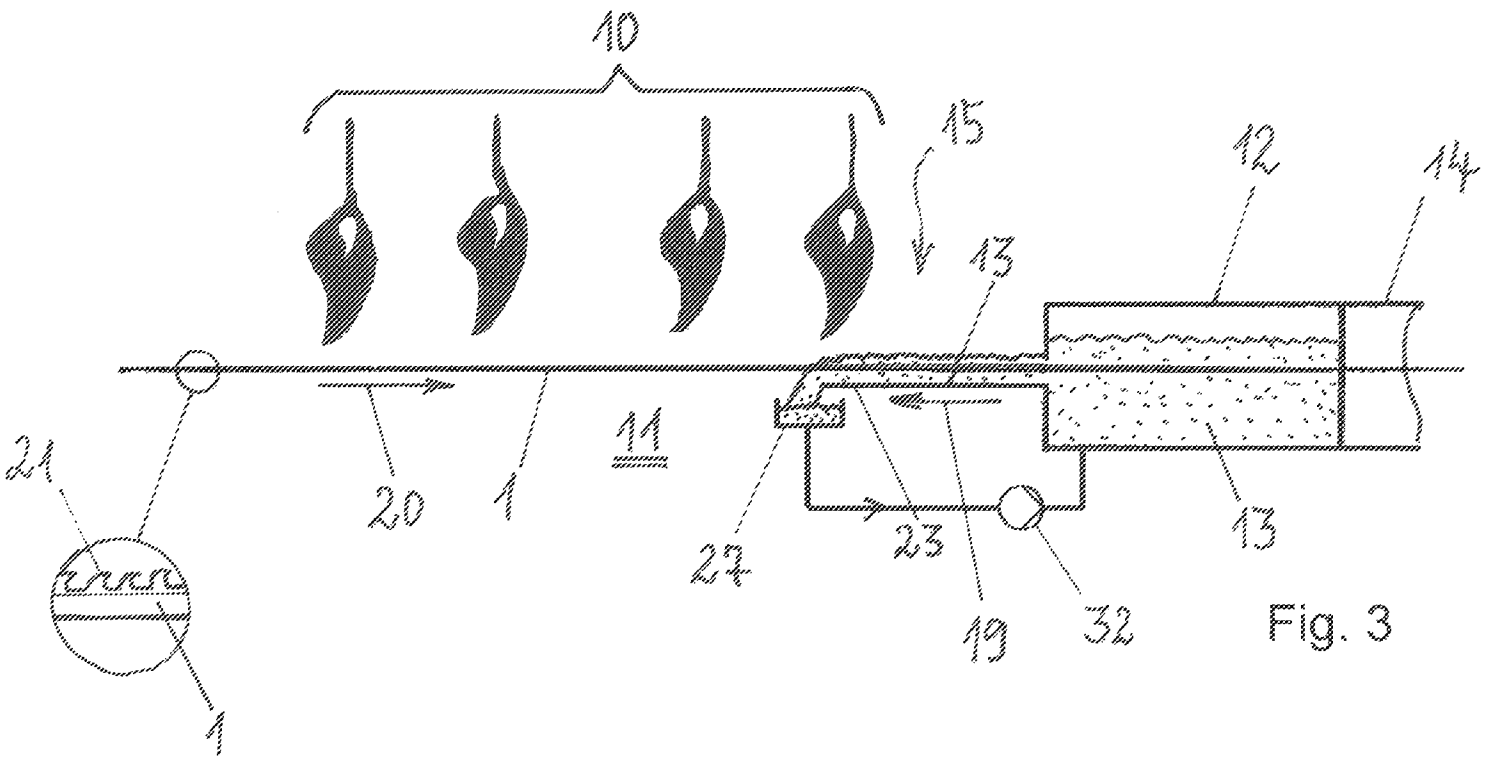
FIG. 3 shows a further view, to an enlarged scale, of the heating region and, following on therefrom, the transition region, wherein the open flame is arranged above the clothing wire.

Finally, FIG. 3 shows the arrangement of a further example of an embodiment of the transition region 15, by means of which a spacing is created between the quenching bath 12 and the heating region 11 having the open flame 10 without the clothing wire 1 being able to come into contact with oxygen. The heating region 11 has open flames 10, which burn upside-down from top to bottom. The clothing wire 1 therein can be so guided through the heating region 11 that the tooth structure 21 faces the open flames 10, as shown in the inset view to an enlarged scale. Alternatively, the clothing wire 1 can here too be arranged in the uncoiled direction, that is to say a lateral face of the clothing wire faces the flame 10 and the opposite lateral face faces away therefrom.

Immediately following on from the region of the open flames 10, the clothing wire 1 enters the quenching liquid 13, which runs through a wire conduit channel 23. In so doing, the clothing wire 1 runs into the wire conduit channel 23, which is of open construction to the top, that is to say in the direction of the open flames 10. This means that the open flames 10 can extend as far as the quenching liquid 13 or even slightly overlap it. The clothing wire 1 runs, in the pass-through direction 20, out from the open flames 10 into the quenching liquid 13 so that all contact with oxygen is avoided.

The quenching liquid 13 runs out from the quenching bath 12 into the wire conduit channel 23 and completely surrounds the clothing wire 1. At the end of the wire conduit channel 23, the quenching liquid 13 spills over and enters a collecting apparatus 27, from which the quenching liquid 13 can be pumped back into the quenching bath 12 by way of a pump 32.

As a result of the quenching liquid 13 running out from the quenching bath 12, the quenching liquid 13 has a flow in a flow direction 19 which is contrary to the pass-through direction 20. As a result of the continuous replacement of the quenching liquid 13 in the wire conduit channel 23, the quenching liquid 13 does not heat up substantially in the region of the wire conduit channel 23 either as a result of contact with the hot clothing wire 1 or as a result of the contact with the open flame 10. As a result, a transition region 15 can be formed by simple means which makes possible a spacing between the open flames 10 and the quenching bath 12 without the clothing wire 1 being able to come into contact with oxygen.

The invention is not limited in its execution to the preferred examples of embodiments described hereinbefore. Rather, many variants are feasible, which make use of the described solution even in the case of embodiments of fundamentally different form. All features and/or advantages, including structural details and spatial arrangements, arising out of the claims, description or drawings can be essential to the invention both on their own and also in the widest variety of combinations.

REFERENCE NUMERALS

100 apparatus system
1 clothing wire
10 open flame
11 heating region
12 quenching bath
13 quenching liquid
14 tempering apparatus
15 transition region
16 protective medium
17 protection chamber
18 entry aperture
19 flow direction
20 pass-through direction
21 tooth structure
22 wire conduit tube
23 wire conduit channel
24 extractor hood
25 rinsing chamber
26 cooling apparatus
27 collecting apparatus
28 partition wall
29 tube entry aperture
30 reel
31 reel
32 pump

The invention claimed is:

1. A method of hardening a clothing wire for processing textile fibres, the clothing wire having a longitudinal direction and a succession of teeth arranged in the longitudinal direction, the method comprising:

guiding the clothing wire through a heating region in a pass-through direction for contact with at least one open flame;

following the heating region, guiding the clothing wire through a quenching bath having a quenching liquid;

subsequent to the quenching bath, guiding the clothing wire through a tempering apparatus; and flushing the clothing wire moving in the pass-through direction around with a protective medium comprising the quenching liquid in a transition region between a region of contact with the open flame and an entry into the quenching bath, including bringing the quenching liquid, with a flow movement in a flow direction from the quenching bath as far as the heating region, the flow direction being opposite to the pass-through direction of the clothing wire.

2. The method according to claim 1, wherein the flushing includes flushing the clothing wire around in the transition region with nitrogen, which constitutes the protective medium.

3. The method according to claim 1, wherein the flushing includes surrounding the transition region by a protection chamber and introducing the protective medium into the protection chamber.

4. The method according to claim 3, wherein the introducing the protective medium into the protection chamber increases a pressure in the protection chamber to greater than atmospheric pressure and further including flowing the protective medium through an entry aperture, through which the clothing wire runs into the protection chamber, and out from the protection chamber into the heating region opposite to the pass-through direction.

5. The method according to claim 1, including bringing the at least one open flame in the heating region to the clothing wire from above the clothing wire.

6. An apparatus for hardening a clothing wire for processing textile fibres, the clothing wire having a succession of teeth arranged in a longitudinal direction of the clothing wire, the apparatus comprising:

a heating region with an open flame through which the clothing wire is arranged to be guided in a pass-through direction;

a quenching bath having a quenching liquid following the heating region;

a tempering apparatus following the quenching bath; and a transition region arranged between a region of contact with the open flame and an entry into the quenching liquid wherein the transition region is constructed for flushing around the clothing wire with a protective medium comprising the quenching liquid, and wherein the transition region includes a wire conduit tube or a wire conduit channel, through which the quenching liquid is arranged to be conveyed in the direction of the heating region.

7. The apparatus according to claim 6, wherein the transition region comprises a protection chamber filled at least partly by a protective medium.

8. The apparatus according to claim 6, wherein the protective medium comprises nitrogen.

9. The apparatus according to claim 6, wherein the at least one open flame is arranged to be brought to the clothing wire in the heating region from above or from below the clothing wire.

* * * * *